United States Patent [19]

Heywood

[11] 4,276,894

[45] Jul. 7, 1981

[54] AUTOMATIC COIN DISPENSER

[75] Inventor: Joseph R. Heywood, 118 Morgan St., Kingsgrove, New South Wales, Australia

[73] Assignees: Joseph Richard Heywood, Kingsgrove; Leonard Hastings Ainsworth, Roseberry, both of Australia

[21] Appl. No.: 41,773

[22] Filed: May 23, 1979

[30] Foreign Application Priority Data

Oct. 24, 1978 [AU] Australia ..... PD6518

[51] Int. Cl.[3] ..... G07D 1/00

[52] U.S. Cl. ..... 133/5 R; 221/121

[58] Field of Search ..... 133/4 R, 4 A, 5 R, 2; 221/113, 119, 120, 121, 123, 132, 258, 277

[56] References Cited

U.S. PATENT DOCUMENTS

| | | | |
|---|---|---|---|
| 2,587,809 | 3/1952 | Arnett | 133/5 R |
| 2,778,368 | 1/1957 | Jaskowiak | 133/2 |
| 2,848,003 | 8/1958 | Gross | 133/2 |
| 3,191,609 | 6/1965 | Gauselmann et al. | 221/123 X |
| 3,319,636 | 5/1967 | Verbeke | 133/2 |

FOREIGN PATENT DOCUMENTS

| | | | |
|---|---|---|---|
| 500751 | 7/1930 | Fed. Rep. of Germany | 221/120 |
| 1210440 | 10/1970 | United Kingdom | 133/4 |

*Primary Examiner*—F. J. Bartuska
*Assistant Examiner*—Edward M. Wacyra

[57] ABSTRACT

An automatic coin dispenser in which coins are stored in a plurality of coin tubes of equal length arranged around the circumference of a rotatable base. The coins are fed into the tubes from above according to the type of machine in which the dispenser is used. Coins projecting above the top of the tubes are swept off into a suitable receptacle. Coins are dispensed from the bottoms of the tubes which are provided with a slot in the wall and an opening in the bottom giving access to the bottom coin of a column of coins for a rotatable coin ejecting mechanism arranged to eject coins radially from the bottoms of a sequence of columns of coins during rotation of the base. The dispenser is further provided with a mechanism to activate or deactivate the coin ejecting mechanism so that a predetermined number of coins may be ejected. Suitable receptacle are provided for surplus coins removed from the tops of the columns and also for coins dispensed.

3 Claims, 5 Drawing Figures

AUTOMATIC COIN DISPENSER

The present invention relates to an automatic coin dispenser capable of storing coins and dispensing a desired number of coins from storage. Such a coin dispenser may be used in a variety of applications, for example, in coin counting and change giving apparatus or in coin freed amusement machines of the type known as poker machines, fruit machines or slot machines.

The invention consists in an automatic coin dispenser comprising a plurality of coin holding tubes of equal length mounted in a circle on a rotatable base, means at the lower end of each tube to support a column of coins in the tube, rotatable coin ejecting means constructed and arranged, when activated, to eject coins from the bottoms of a sequence of columns of coins during rotation of said base, means to activate or deactivate said coin ejecting means, means to rotate the base, means to collect coins ejected, means to remove from said columns of coins, coins projecting above the tops of said tubes as the base rotates and means to receive coins so removed.

Figure 1:
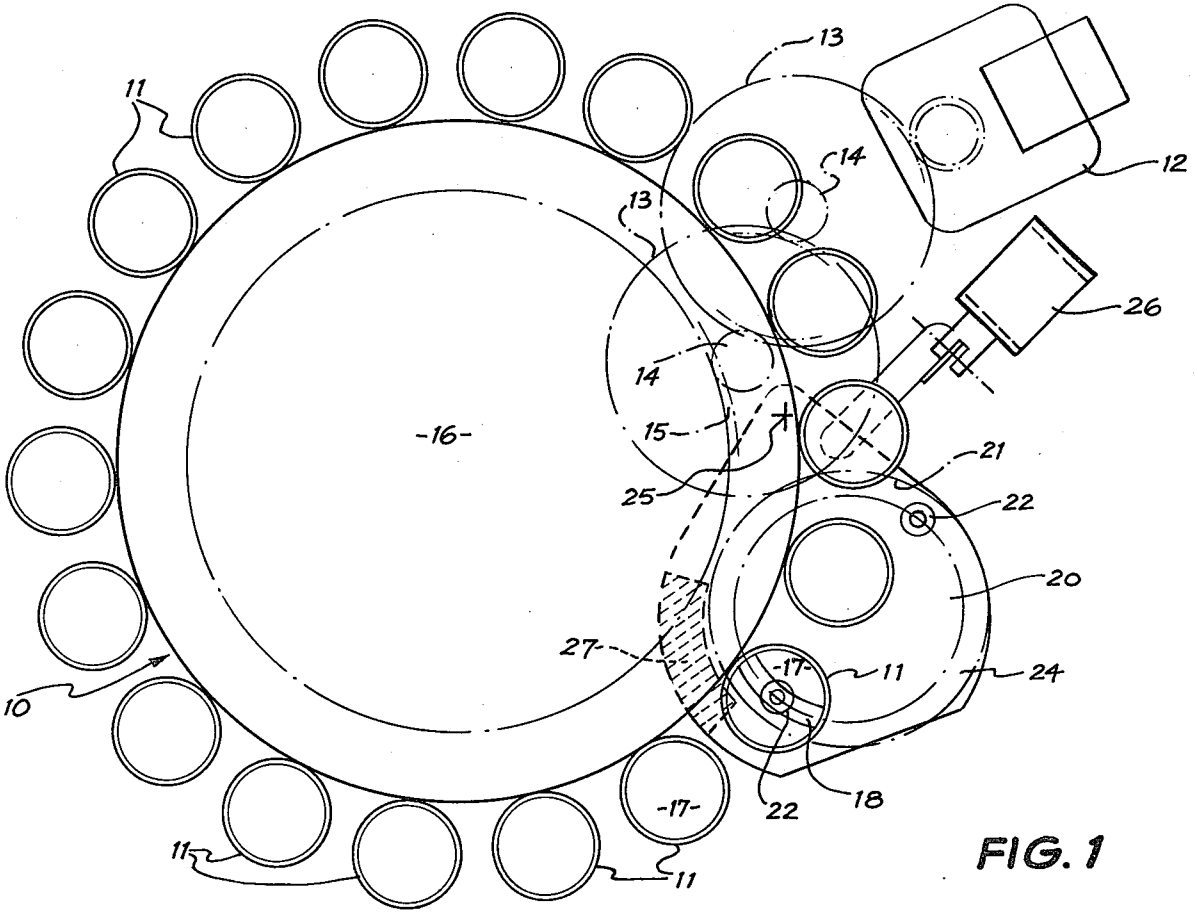
Figure 2:
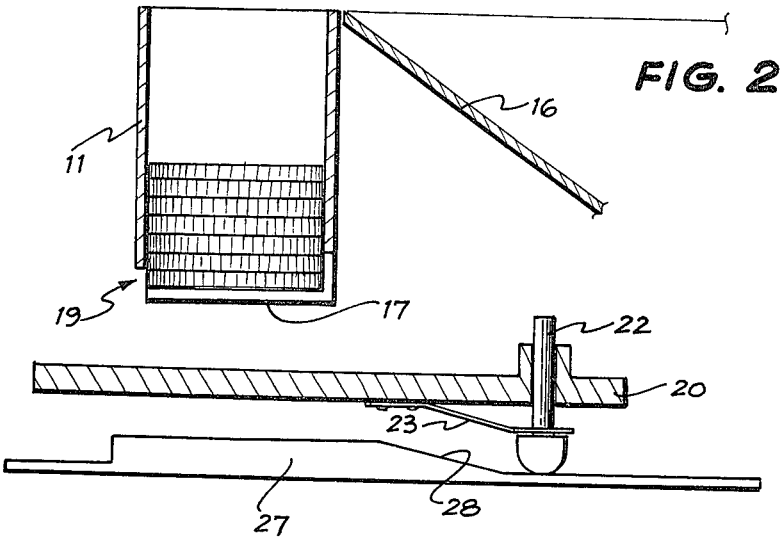
Figure 3:
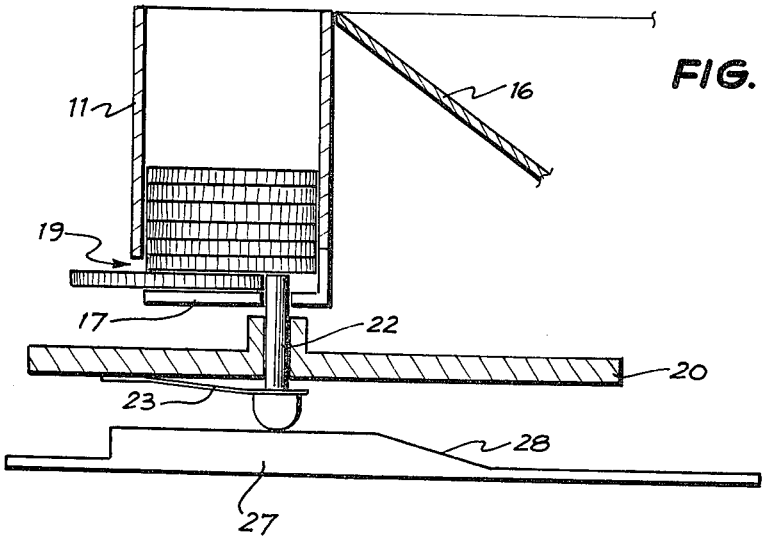
Figure 4:
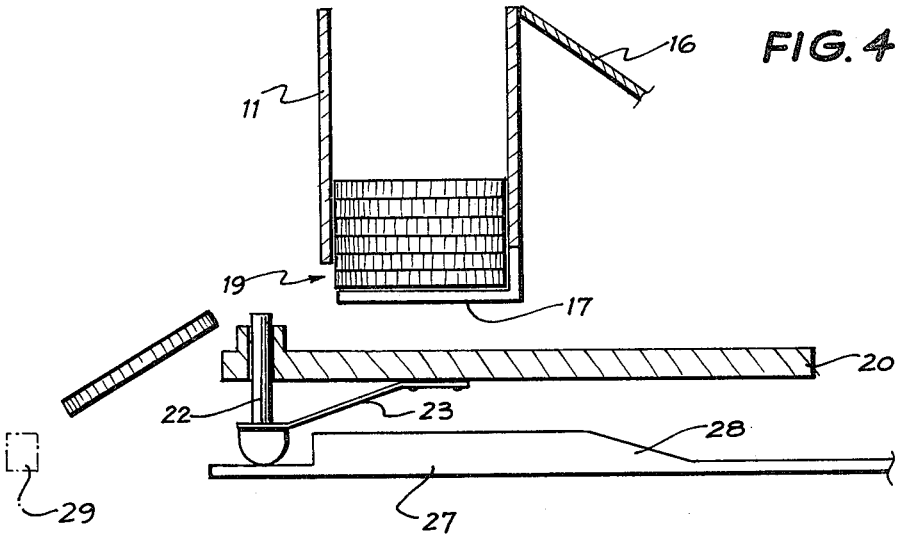
Figure 5:
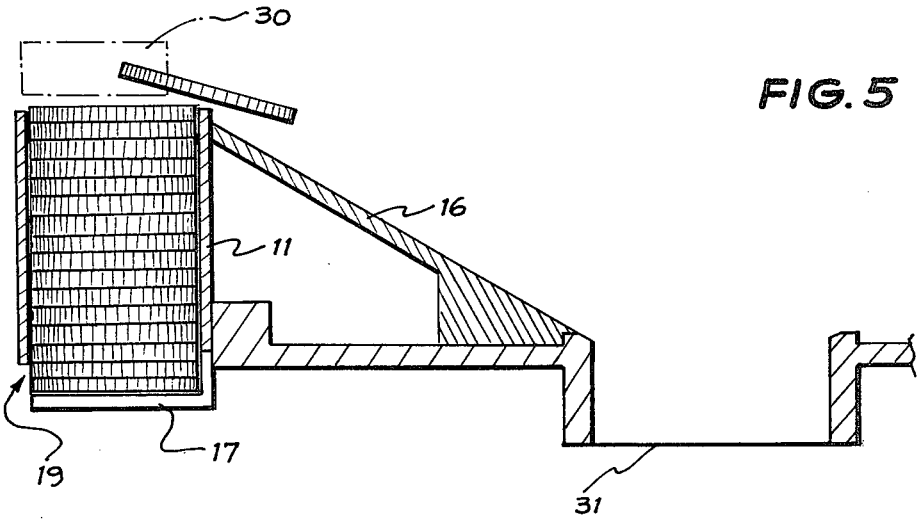

In order that the invention may be better understood and put into practice a preferred form thereof is hereinafter described by way of example with reference to the accompanying diagrammatic drawings in which:

FIG. 1 is a plan view of the essential parts of a coin handling apparatus according to the invention, FIGS. 2, 3 and 4 are sectional views of one tube showing the various stages of coin ejecting and, FIG. 5 is a sectional view of one side of the apparatus illustrating the manner in which surplus coins are discharged.

The apparatus consists of a circular rotatable base 10 having arranged around its circumference and affixed to it a plurality of coin tubes 11 of equal length, the whole assembly being free to rotate around the centre of the base and being rotated in use, by means of an electric motor 12 driving through gears 13 and 14, the gear 14 meshing with a toothed ring 15 on the base 10. In the centre of the base is a funnel 16 the function of which is described below.

Each of the coin tubes is provided with a bottom 17 in which is formed an arcuate slot 18 (only one such arcuate slot is shown in FIG. 1 the other tube being supposed to have coins in them). Immediately above the bottom 17, at the outer side of the coin tube, is a coin exit slot 19 through which a coin may be ejected radially outwardly from the bottom of a pile of coins in a coin tube.

The ejection of the coins from the tubes is effected by an ejector disc 20 rotatably mounted beneath the tube at one side of the base 10. The ejector disc 20 is rotated with the base 10 by means of the toothed ring 15, which is on an axis parallel with that of gear 14, and which meshes with a toothed ring 21 on the ejector disc 20. In the ejector disc 20 are two ejector pins 22 which are normally held in the downward or unactivated position shown in FIGS. 2 and 4, by the springs 23. In this position the pins 22 are clear of the underside of the bottoms 17 of the coin tubes 11. Beneath the ejector disc is mounted an ejector lever 24 which is pivotable about the point 25 by means of the solenoid 26. The ejector lever 24 has on it a raised cam section 27 the configuration of which is seen in FIGS. 2, 3 and 4.

If the base 10 and the ejector disc are rotated while the ejector lever is in the unactivated position shown in FIG. 1 both will rotate and no contact will be made between the ejector pins 22 and coins in the coin tubes 11. Rotation in this position is used as a means of filling the coin tubes in the manner described below. If however the solenoid 26 is activated to bring the raised cam section 27 into the activated position in which it lies in the path of rotation of the ejector pins, as the pins are rotated beneath the coins tube, each pin in turn will encounter the ramp portion 28 of the raised cam section 27 and will enter the curved slot at the bottom 17 of a coin tube as illustrated in FIG. 3. This will cause the coin to be ejected as shown in FIGS. 3 and 4 and after passing the coin tube the pin 22 will be returned by the spring 23 to the position shown in FIG. 4. Thus as the base is rotated coins are delivered from each tube in turn and each coin as it falls passes a photoelectric device indicated diagrammatically at 29 which in conjunction with electrical circuitry not shown is used to count the number of coins delivered.

From the above it will be appreciated that the number of coins dispensed can be readily controlled by controlling the position of the ejector lever 24. Thus when the apparatus is required to dispense a given number of coins the solenoid is actuated to bring the ejector lever 24 into the activated position, the coins are counted as they are ejected and once the desired number of coins has been ejected, electrical circuitry referred to above acts to de-energise the solenoid 26 to restore the ejector lever to the deactivated position shown in FIG. 1. Once the ejector lever is returned to this position and dispensing of coins is stopped, rotation of the base 10 may be stopped but the moment at which this is done is in no way critical.

The coin tubes 11 may be replenished in a variety of different ways depending on the type of apparatus with which the dispenser is used. In a change giving machine for example coins entering the machine may be fed into a plurality of coins dispensing devices according to the invention, each having coin tubes intended to receive the coins of a particular denomination, the coins being stored in the appropriate dispenser until required for use. On a coin being inserted into the change giving machine it is routed to the appropriate dispenser and in so doing operates a switch to rotate the dispenser by one tube pitch. In this way each time a coin of a particular denomination is received it will index the dispenser and so replenish all the tubes in time. When all the tubes are full any further rotation of the dispenser causes them to be pushed off by a stop 30 (FIG. 5) into the centre funnel 16 of the dispenser and directed through the aperture 31 to a cash box below.

In a poker machine, fruit machine or slot machine a dispenser according to the invention may be used for holding coins and paying them out accurately as required when a player obtains a win on the machine. In such an application a person wishing to play a machine inserts a coin into the machine which after operating the necessary switches is fed into an entry tube (not shown) in the cover of the coin dispenser. In so doing each coin causes the dispenser to index through one tube and as described above gradually replenishes all the tubes until they are full, all the surplus coins being directed elsewhere by means of an overflow system through the centre funnel 16.

The preferred form of the invention described above has the following advantageous features:

(a) The ability to store a large number of coins within a relatively small space.

(b) The ability to dispense an exact number of coins or tokens.

(c) A very rapid rate of operation.

(d) Positive ejection of coins under a force that can, if desired, be used to operate a switch or other mechanism.

(e) An ability to replenish itself.

(f) The ability to divert surplus coins when full and an ability to count accurately that diverted surplus.

Such counting means are arranged in the path of the coins passing out of the funnel and are of a conventional nature.

Mechanically the apparatus is simple and involves a minimum number of moving parts. It is therefore simple to maintain and reliable service can consequently be expected.

The preferred form of the invention described above is given by way of example only as constituting one embodiment of the invention within the general scope thereof as defined above.

I claim:

1. An automatic coin dispenser comprising a plurality of coin holding tubes of equal length mounted in a circle on a rotatable base, means at the lower end of each tube to support a column of coins in the tube, rotatable coin ejecting means constructed and arranged when activated to eject coins from the bottoms of a sequence of columns of coins during rotation of said base, means to activate or deactivate said coin ejecting means, means to rotate the base, means to collect coins ejected, means to remove from said columns of coins, coins projecting above the tops of said tubes as the base rotates and means to receive coins so removed, and wherein the coin ejecting means comprises a member rotated in synchronism with said base beneath the said tubes, at least one coin ejecting member on said rotated member, said at least one coin ejecting member being movable to and from an activated position in which during rotation it makes contact through an aperture in each said tube with the bottom coin of each passing column to eject that coin from its tube and to and from a deactivated position in which no contact is made with coins, said means to activate or deactivate said coin ejecting means comprising cam means movable to and from an activated position in which each coin ejecting member is caused by said cam means to assume an activated position during rotation beneath said tubes.

2. An automatic coin dispenser according to claim 1, wherein the means to rotate the base is electric motor means that rotates both the base and the coin ejecting means through gearing.

3. An automatic coin dispenser according to claim 1 wherein the means to receive coins removed from the tops of said column comprises a funnel arranged within the base and having a central aperature.

* * * * *